United States Patent [19]

Docherty et al.

[11] Patent Number: 4,834,650

[45] Date of Patent: May 30, 1989

[54] SEALED ROTARY HEARTH FURNACE WITH CENTRAL BEARING SUPPORT

[75] Inventors: James P. Docherty, Carnegie; Beverly E. Johnson, Pittsburgh; Joseph Beri, Morgan, all of Pa.

[73] Assignee: Salem Furnace Co., Pittsburgh, Pa.

[21] Appl. No.: 206,526

[22] Filed: Jun. 14, 1988

[51] Int. Cl.[4] ..... F27B 9/16

[52] U.S. Cl. ..... 432/138; 432/139; 432/235; 432/242

[58] Field of Search ..... 432/136–139, 432/115, 242, 235

[56] References Cited

U.S. PATENT DOCUMENTS

| | | | |
|---|---|---|---|
| 2,676,006 | 4/1954 | Martin | 432/138 |
| 3,470,068 | 9/1969 | Kemmerer et al. . | |
| 3,652,426 | 3/1972 | Oleszko | 202/201 |
| 3,740,184 | 6/1973 | Oleszko | 432/139 |
| 3,763,011 | 10/1973 | Allred | 432/138 |
| 3,998,703 | 12/1976 | Harrell | 432/138 |
| 4,207,061 | 6/1980 | Ikenaga et al. | 432/138 |
| 4,669,977 | 6/1987 | Johnson et al. | 432/139 |

*Primary Examiner*—Henry C. Yuen

*Attorney, Agent, or Firm*—Webb, Burden, Ziesenheim & Webb

[57] ABSTRACT

The furnace has a hearth which rotates inside a stationary closed chamber and is supported therein on vertical cylindrical conduit which extends through the furnace floor and is supported by a single center bearing. The charge is deposited through the furnace roof on the rim of the hearth as it rotates and is moved toward the center of the hearth by rabbles. Externally generated hot gases are introduced into the furnace chamber below the hearth and rise through perforations in the hearth and up through the charge. Exhaust gases are withdrawn through the furnace roof. Treated charge drops from a center outlet on the hearth into the vertical cylindrical conduit which extends downwardly through the furnace floor to which it is also sealed.

9 Claims, 3 Drawing Sheets

SEALED ROTARY HEARTH FURNACE WITH CENTRAL BEARING SUPPORT

FIELD OF THE INVENTION

This invention relates to rotary furnaces for drying and heating particulate material such as coal, coke, grain and the like in controlled atmospheres. More particularly, the invention is concerned with such a furnace which does not require a conventional continuous seal around the circumference located on the sidewall to separate the furnace enclosure from the atmosphere.

BACKGROUND OF THE INVENTION

Rotary hearth furnaces for the heating of particulate material in controlled atmospheres are well known and are described in Kemmerer, et al. U.S. Pat. No. 3,470,068 of Sept. 30, 1969 and Oleszko, U.S. Pat. No. 3,652,426 of Mar. 28, 1972. A stationary hearth rotary roof furnace for that purpose is disclosed in Johnson, et al. U.S. Pat. No. 4,669,977 of June 2, 1987. A disadvantage of both types of furnace where the atmosphere must be controlled is the requirement of a seal between the hearth and furnace chamber or between the roof and furnace chamber. Hearth diameters of 25 feet are not uncommon and the extent of the seal required for such furnaces limits the sealing material to a granular substance such as sand or to a liquid, generally water. A liquid seal can be made quite effective; however, water reacts with some of the gases evolved when coal is heated under controlled conditions. The rotary hearth of our invention is totally enclosed and sealed, whereby conventional peripheral wall or roof seals are eliminated.

SUMMARY OF THE INVENTION

Our furnace to be described in detail hereinafter has a stationary cylindrical sidewall, a roof affixed thereto and a rotary hearth. The furnace chamber has an imperforate floor below the hearth providing a totally enclosed furnace chamber. The hearth rotates on a vertical cylindrical conduit which extends downwardly through the floor at the center of the chamber attached to a support bearing beneath the furnace floor and is sealed to the floor as will be described hereinafter. Heating gas is injected into the furnace chamber below the hearth and rises through perforations in the hearth into the charge. Spent gas is drawn off through the furnace roof. A feed hopper is mounted on the furnace roof near its circumference to discharge feed material onto the hearth. The feed material is moved toward the center of the hearth as it revolves by conventional roof mounted rabbles and leaves through a discharge port in the center of the hearth into the vertical cylindrical conduit which extends through the furnace chamber floor.

DESCRIPTION OF PREFERRED EMBODIMENTS

Figure 1:
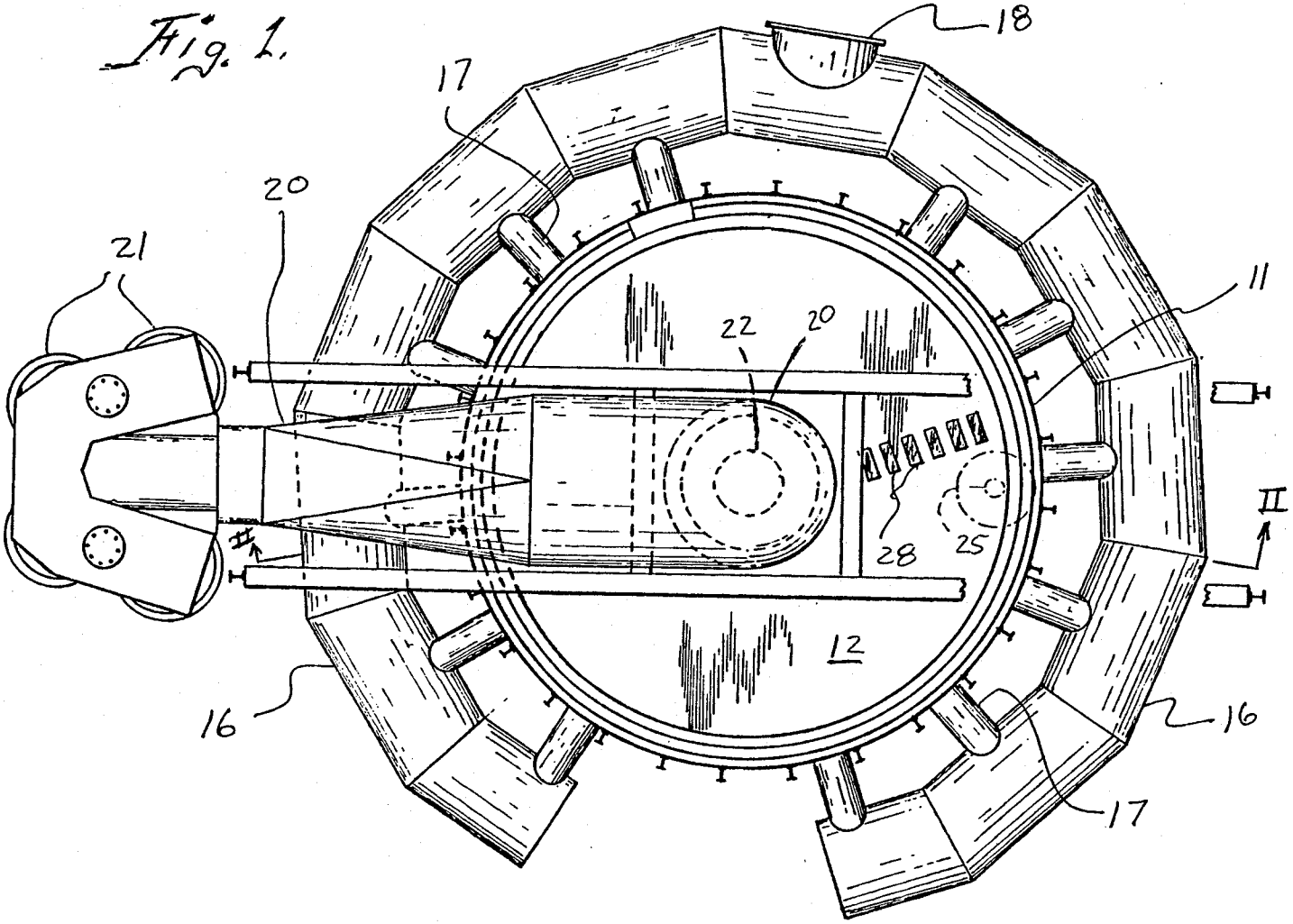
FIG. 1 is a plan of our furnace.
Figure 2:
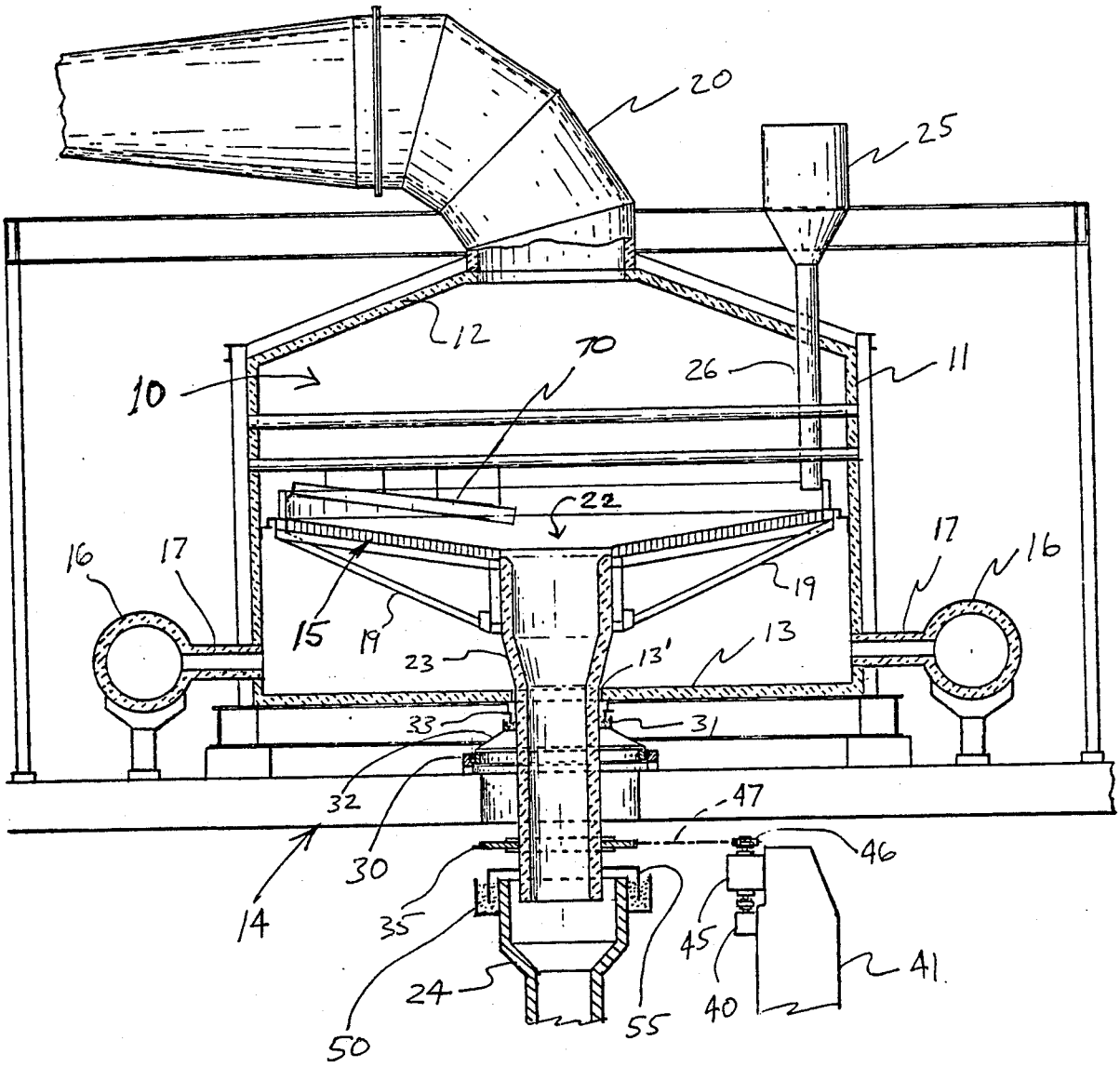
FIG. 2 is a vertical section through the furnace of FIG. 1 taken along the lines II—II.
Figure 3:
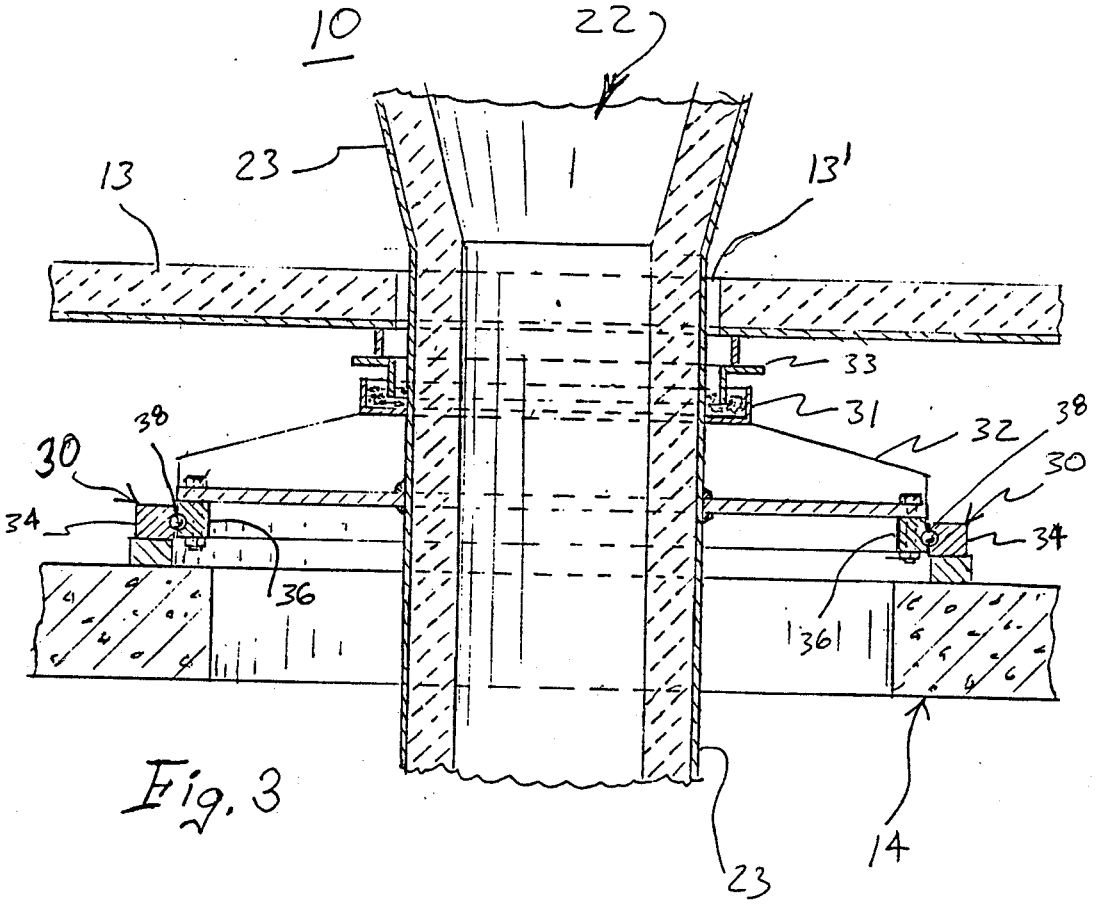
FIG. 3 is a partial fragmentary side view of the seal and bearing support surrounding the vertical cylindrical conduit.

A furnace according to our invention shown in FIGS. 1 and 2 comprises a cylindrical chamber 10 having a wall 11, a stationary roof 12 and a stationary furnace floor 13. The structure is supported on structural foundation or base 14. Within chamber 10 and positioned intermediate roof 12 and floor 13 is a circular rotary hearth 15 to be described in more detail hereinafter. Chamber 10 is surrounded by a manifold or bustle pipe 16 which supplies hot gas to the chamber through wall 11 by means of a plurality of offtakes 17. Hot gas is delivered to bustle pipe 16 through intake 18 from an external source not shown. The bustle pipe offtakes 17 are located intermediate furnace floor 13 and hearth 15. Hearth 15 is perforated as shown in the above-mentioned Johnson, et al. U.S. Pat. No. 4,669,977 of June 2, 1987, so that hot gases introduced below the hearth rise through the hearth and heat the charge. The exhaust gases are withdrawn from chamber 10 through flue 20 at the center of roof 12 and are passed through cyclones 21 to remove entrained particles therefrom.

Hearth 15 slopes downwardly from its circumference to its open center 22 into a vertical cylindrical conduit 23 which extends through a central orifice 13' in furnace floor 13 into a stationary delivery chute 24. A feedbin 25 is mounted above furnace roof 12 and delivers charge through pipe 26 to hearth 15 near its circumference. Conventional stationary rabbles 28 depending downwardly from the roof 12 are angularly arranged to move the charge from the hearth circumference toward the entry 22 of vertical cylindrical conduit 23 as the hearth 15 revolves.

Hearth 15 is supported by struts 19 attached to the vertical cylindrical conduit 23 and to the hearth periphery. The vertical cylindrical conduit 23 extends through furnace floor 13 and is supported for rotation on a single center bearing 30 located outside furnace chamber 10. An outer ring-shaped bearing race 34 of center bearing 30 is mounted on the foundation floor 14 while inner race 36 is carried by a gusset plate 32 attached to the outer sidewall of conduit 23. A plurality of roller elements 38 are positioned between the races 34, 36 to permit rotation of the conduit 23. The bearing 30 is a heavy duty commercially available design for combined high thrust, moment and radial capacity. Such a bearing 30 is manufactured by Rotek Incorporated. Heretofore, such bearings have found use in heavy duty cranes, excavators, derricks and the like.

The outside wall of the vertical cylindrical conduit 23 is sealed to furnace floor 13 by a rotating seal trough 31 carried by gusset structure 32 attached to bearing 30 and cylindrical conduit 23 and a stationary seal blade 33 attached to floor 13 around opening 13' therein. The seal is preferably a liquid seal, such as water.

Furnace chamber 10 is shown in FIG. 2 as having a frusto-conical roof 12. Where high pressures are required in the furnace chamber such a roof shape withstands the service environment better than a flat roof. A flat roof, however, can be used in those applications where such high pressures are not encountered.

A chain sprocket 35 is affixed to the conduit 23. A motor 40 and speed reducer 45 are mounted with vertically aligned shafts on a supporting framework 41. The speed reducer 45 has a drive sprocket 46 aligned with chain sprocket 35 and is connected therewith with a drive chain 47.

A lower water seal is estalished by a ringshaped trough 50 carried by stationary delivery chute 24 and ring-shaped seal blade 55 carried by rotating conduit 23.

In the operation of our apparatus, the charge material to be treated is loaded into the feedbin 25 and discharged through pipe 26 onto the hearth 15 at its outer periphery. Hearth 15 rotates about the vertical axis extending through its center on bearing 30. Heating gas introduced into the furnace chamber 10 below hearth 15 through manifold 16 and offtakes 17 rises through perforations in the hearth 15 into the charge. As the hearth rotates, the rabbles 28 suspended above hearth 15 move the charge toward port 22 for discharge from the furnace through the rotating vertical cylindrical conduit 23. A levelling rake 70 in the form of a straight bar or beam is positioned parallel to the hearth 15 behind the rabbles to smooth the furrows in the top of the charge formed by the rabbles. This levelling provides a uniform charge bed height and results in improved gas distribution through the charge bed.

Figure 4:
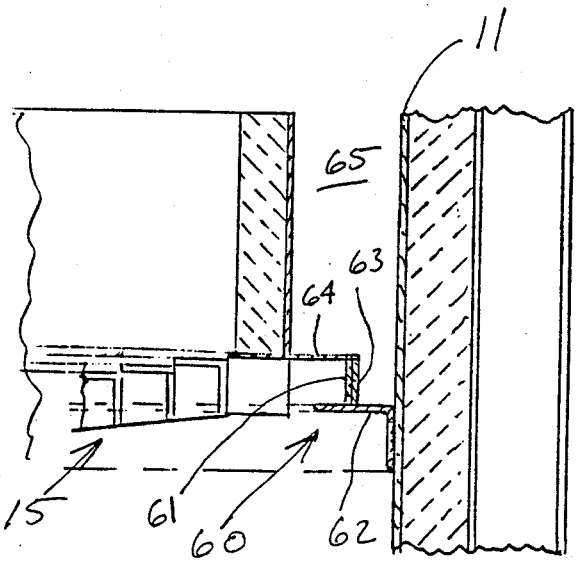
FIG. 4 is a partial fragmentary view of the side expansion seal between the rotary hearth and stationary furnace sidewall.

A sidewall gas seal 60 is provided between the periphery of rotating hearth 15 and stationary sidewall 11 to insure that the hot gases from manifold 16 and offtakes 17 pass through the perforate bottom of the hearth rather than short circuiting along the periphery. As shown in FIG. 4, seal 60 comprises a vertical web 61 carried by an angle member 62 attached to the wall 11. A complementary vertical web 63 is attached to a circumferential flange 64 carried by the hearth 15 to rotatably engage the stationary angle 62 to prevent gas flow within the annular space 65 between hearth 15 and sidewall 11. Thermal expansion and contraction is also accommodated by seal 60 as webs 61 and 63 are free to move laterally.

In the foregoing specification we have set out certain preferred embodiments and practices of our invention; however, it will be understood that this invention may be otherwise embodied within the scope of the following claims.

Having thus described our invention with the detail and particularity required by the Patent Laws, what is claimed and desired to be protected by Letters Patent is set forth in the following claims.

We claim:

1. A rotary hearth furnace comprising a stationary furnace wall with connecting roof and floor defining a closed furnace chamber therein; a rotatable hearth within said furnace chamber having a gas perforate surface for supporting a charge material thereon and having an open center region; a vertical cylindrical conduit supporting said hearth and communicating with said open center region thereof, said vertical cylindrical conduit extending from said hearth downwardly through an opening formed in said furnace floor and said vertical cylindrical conduit supported for rotation on bearing means positioned beneath said furnace floor; sealing means associated with said vertical cylindrical conduit and said furnace floor to seal-off said opening therebetween; drive means for rotating said vertical cylindrical conduit and said hearth, feed means extending into said furnace chamber for charging particulate material onto said hearth, means for supplying hot gases to said furnace chamber between said hearth and said floor; means for withdrawing spent gas from the furnace chamber above said hearth; rabble means for moving the charge material across said hearth for discharge into said open center region and said vertical cylindrical conduit.

2. The rotary hearth furnace of claim 1 wherein said vertical cylindrical conduit includes a discharge end which communicates with the inlet end of a stationary delivery chute for transport of a processed charge material from said furnace.

3. The rotary hearth furnace of claim 2 including sealing means associated with said vertical cylindrical conduit and said delivery chute for sealing-off an annular space therebetween.

4. The rotary hearth furnace of claim 1 wherein said bearing means comprises a ring-shaped central bearing having an outer bearing race supported by means positioned beneath said furnace floor and an inner bearing race attached to an outer sidewall of said vertical cylindrical conduit.

5. The rotary hearth furnace of claim 1 wherein said sealing means comprises a trough for containment of a sealing medium therein said trough attached to and extending around an outer sidewall of said vertical cylindrical conduit, a ring-shaped seal blade attached to said furnace floor surrounding said opening therein and downwardly depending therefrom to engage the sealing medium in said trough.

6. The rotary hearth furnace of claim 5 wherein the sealing medium is water.

7. The rotary hearth furnace of claim 1 including a stationary levelling rake means extending generally parallel to and above said hearth to smooth a top surface of said charge in a location spaced rearwardly from said rabble means.

8. The rotary hearth furnace of claim 1 including circumferential flange and web means extending outwardly from a periphery of said hearth, a complementary flange and web means extending around the wall of said furnace to slidably engage one another to prevent hot gas flow between said hearth perimeter and the furnace wall.

9. The rotary hearth furnace of claim 1 wherein the drive means comprises a chain sprocket attached to an outer sidewall of the vertical cylindrical conduit, a motor means having a drive sprocket, a drive chain operably connected to said drive sprocket and said driven chain sprocket for controlled rotation thereof.

* * * * *